US005152013A

United States Patent [19]

Johnson

[11] Patent Number: 5,152,013

[45] Date of Patent: Oct. 6, 1992

[54] VERSATILE TANDEM BELT

[76] Inventor: Douglas A. Johnson, 19331 Euclid Path, Farmington, Minn. 55024

[21] Appl. No.: 741,110

[22] Filed: Aug. 6, 1991

[51] Int. Cl.[5] ..... A41F 9/00

[52] U.S. Cl. ..... 2/321; 2/311; 2/312; 2/319; 2/338; 224/253

[58] Field of Search ..... 2/321, 311, 312, 319, 2/331, 333, 336, 338; 224/253; 54/37, 44, 46, 47, 49; 280/801, 290; 182/3

[56] References Cited

U.S. PATENT DOCUMENTS

| | | | |
|---|---|---|---|
| 3,184,883 | 5/1965 | McCook | 2/311 |
| 3,487,474 | 1/1970 | DeMeo | 2/311 |
| 3,564,616 | 2/1971 | Battaglia | 2/311 |
| 3,840,902 | 10/1974 | McNeill | 2/311 |
| 3,940,801 | 3/1976 | Riggs et al. | 2/311 |
| 4,028,742 | 6/1977 | Marquis | 2/311 |
| 4,413,358 | 11/1983 | Jimenez | 2/321 |
| 4,429,419 | 2/1984 | Snyder | 280/290 |
| 4,560,097 | 12/1985 | Reynolds et al. | 280/290 |
| 4,625,334 | 12/1986 | Proffer | 2/311 |
| 5,081,719 | 1/1992 | Donnelly | 2/311 |

FOREIGN PATENT DOCUMENTS

| | | | |
|---|---|---|---|
| 106078 | 11/1926 | Austria | 280/290 |
| 254139 | 7/1926 | United Kingdom | 182/4 |
| 2123677 | 2/1984 | United Kingdom | 182/3 |

*Primary Examiner*—Werner H. Schroeder
*Assistant Examiner*—Gloria Hale
*Attorney, Agent, or Firm*—Robert C. Baker

[57] ABSTRACT

The stabilizing belt comprises a pliable belt band, means for securing the band about the waist of the forward person of a tandem pair, and at least two discrete hand grip assemblies for the rearward person of the tandem pair. Each of the hand grip assemblies is adjustable to different locations along the belt band and yet is securely held at a selected location along the belt band when the belt band is secured in taut condition about the waist of the forward person. An anchor member is the base structure of each hand grip assembly. It is mounted on the belt band for adjustability along the belt band. A loop of material is then carried by the anchor member and has a portion in spaced relationship from the belt band for hand gripping by the rearward person.

24 Claims, 2 Drawing Sheets

VERSATILE TANDEM BELT

SPECIFICATION

BACKGROUND OF THE INVENTION

This invention relates to a versatile stabilizing belt for a tandem pair and more particularly to a tandem belt having hand grip assemblies readily adjustable to different locations along the belt.

It is common practice for the rearward person of a tandem pair to hold on by gripping the forward person about the waist. Such has been the characteristic of tandem relationships on motorcycles, toboggans, snowmobiles, horses, as well as in some sports or recreational activities such as waterskiing and even parachuting. Where the tandem relationship is to be maintained for only a short period, the inconvenience or awkwardness of such improvised holding does not present an especially serious hazard. Too frequently, however, the tandem relationship is repeated or maintained for relatively long periods, with the rearward person developing fatigue in the arms and hands and attempting to adjust positions for the arms and hands in a manner which induces instability and the hazard of losing one's grip and slipping away from the forward person.

Tandem rider belts proposed by others have not, insofar as known, enjoyed any significant use. Most have provided hand grip members that must always remain in fixed positions on the belts. This approach induces fatigue because of the rigidity or single position of hand gripping afforded the rearward person. Some have proposed an exterior hand grip belt extending parallel to the waist belt for the forward person, so as to allow the rearward person changes of position for hand gripping. This approach, however, relies on a very strong hand grip at an awkward hand angle on the exterior hand grip belt, with the result that hand fatigue is induced because of the awkward strong gripping required. Others have proposed movable hand grip members that easily slip out of a selected position, which in turn causes the rearward person to expend energy in attempting to maintain the hand grip members against slippage movement from a desired position.

Insofar as is known, no one heretofore has provided a stabilizing belt equipped with adjustable hand grip members, easily independently adjustable to any position along the length of the waist belt of the forward person, but which remain stable in selected position for varied hand grip orientation by the rearward person of the tandem pair after the belt is secured about the waist of the forward person.

SUMMARY OF THE INVENTION

This invention provides a stabilizing belt for a tandem pair. The belt comprises a pliable belt band and means for securing the band about the waist of the forward person of a tandem pair. It further comprises two discrete hand grip assemblies for the rearward person of the tandem pair. Each hand grip assembly comprises an anchor member mounted on the belt band for adjustability to different locations along the belt band, and a loop of tough material carried by the anchor member with a portion of the loop available for hand gripping by the rearward person.

The preferred mounting of the anchor member is a threaded mounting of it on the belt band. The preferred anchor members are equipped with slot openings extending transversely to the belt band and through which the belt band may be threaded so as to permit easy shifting of each anchor member along the length of the belt band when that belt band is in loose or non-taut condition. But when the belt band thereafter is secured in taut condition about the waist of the forward person, the anchor members stay in selected position, against sliding along the length of the belt band. Ideally, the loop of tough material carried by the anchor member is mounted to the anchor member by threading the material of the loop through an aperture or holder portion of the anchor member; and most preferably, the material forming the extent of the loop is threaded through two apertures on each anchor member, one at the upper and the other at the lower extremity of the anchor member.

Although the portion of the loop extending in spaced relationship to the belt band may itself serve as a handle member for hand gripping, the invention most preferably is practiced by equipping that portion of the loop of material with a spool-shaped handle member which provides extra body or bulk for ease and comfort of hand gripping. Further, spool-shaped handle members preferably are formed of pliable or elastomeric foam material having an outer skin or integument substantially impervious to water so as to float and thereby enhance ease of location of the entire stabilizing belt should it be accidentally dropped in water in preparation for use in water sport activities.

The belt of the invention is most ideally formed of relatively light weight but extremely strong materials, for example, woven nylon belting may be employed for the belt band as well as the loops of tough material for the hand grip assemblies. Relatively rigid plastics are suitable for use in forming the anchor members as well as fastening means for the belt.

Still other benefits and advantages of the invention will be evident as this description proceeds.

DESCRIPTION OF THE PREFERRED EMBODIMENT

Figure 1:
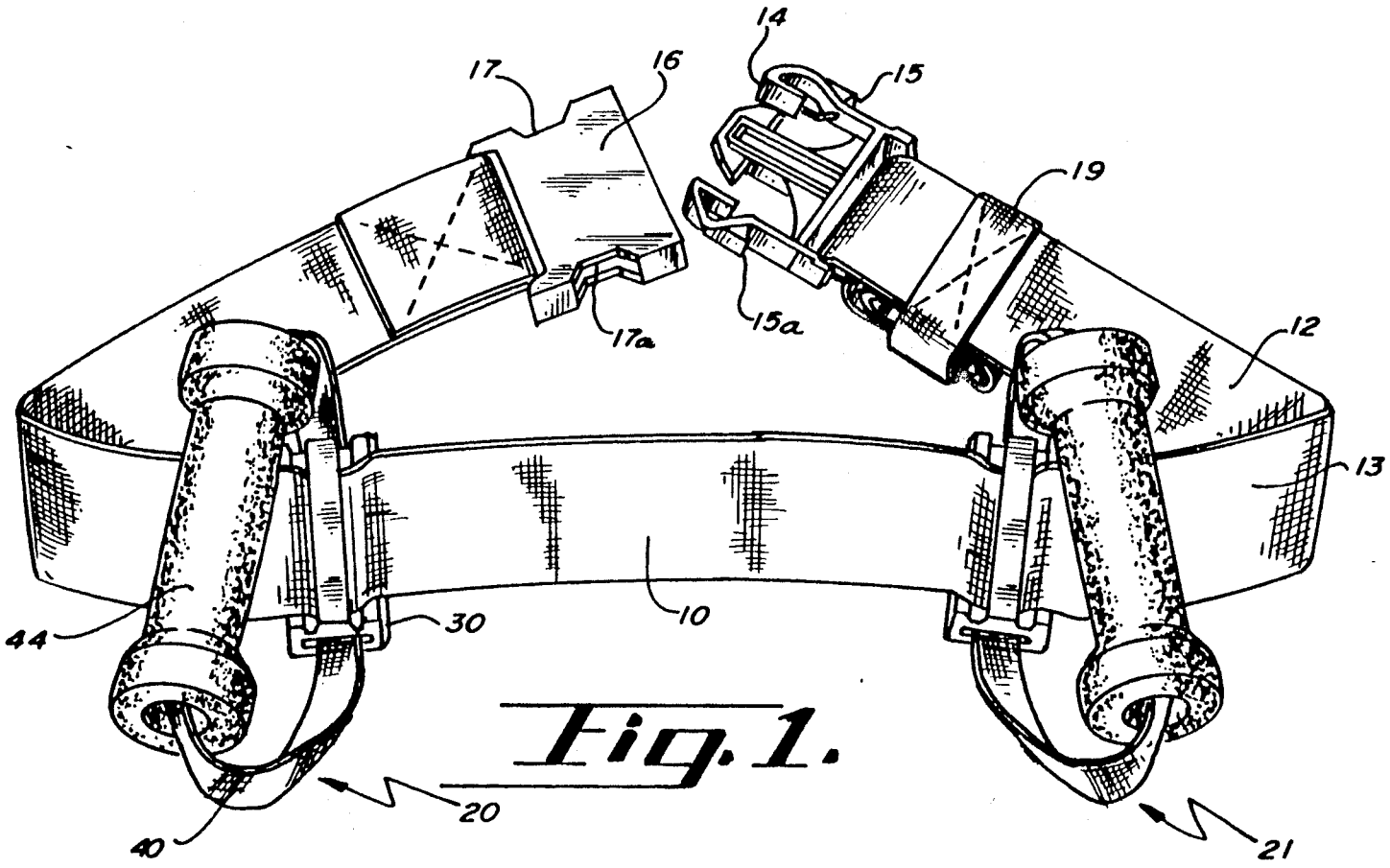
FIG. 1 is a schematic perspective view of the composite belt of the invention in non-taut condition and with the ends of the belt band disengaged.

Referring particularly to FIG. 1, the stabilizing belt of the invention comprises a belt band 10, any suitable means (e.g. male 14 and female 16 fastening elements) for securing the band about the waist of the forward person of a tandem pair, and at least two discrete hand grip assemblies 20 and 21 for the rearward person of a tandem pair.

The hand grip assemblies suitably are identical, and therefore detailed description will be directed to one with the understanding that the other is preferably identical. Each hand grip assembly comprises (see assembly 20) an anchor member 30 and a loop of tough material 40. The anchor member 30 is mounted on the belt band in a manner permitting adjustability of it to different locations along the belt band. The loop 40 of material is carried by the anchor member and has a portion of it in spaced relationship from the belt band for hand gripping by the rearward person of a tandem pair. The portion of the loop in spaced relationship from the belt band may itself be hand gripped by the rearward person; but most preferably, a specially contoured handle in the form of a spool-type member is carried by the loop and functions as the handle 44 for hand gripping.

To be noted is that the belt band has an inner or interior face 12 and this face of the band is pressed against the waist of the forward person. The outer or exterior face 13 of the belt band is opposite the inner or interior face 12. The width of the belt band may vary as desired. It preferably is at least about 3 centimeters in width from its upper edge to its lower edge, and most ideally at least about 5 cm in width. It may be much wider, but generally not more than about 15 or 20 cm in width. Ideally, the belt band is formed of tough, pliable material; and woven nylon belting material is very suitable to use. Other useful materials include tough pliable synthetic materials as well as natural materials such as leather. Stretchy elastic materials are undesirable for use as a belt band. The band should be tough and pliable but resistant against elasticized stretching away from the waist of the forward person.

Suitable means for securing the belt band about the waist of the forward person may comprise fastening elements at opposite ends of a length of the belt band. For example, a male fastening element 14 may be equipped with lateral prong members with locking projections 15 and 15*a* at one end of a belt band. A female element 16 may be equipped with lateral finger cavity areas 17 and 17*a* having openings through which lock projections 15 and 15*a* project upon insertion of the male element 14 into the female element 16. This effectively causes locking of the elements 15 and 15*a* of the male part in a laterally projecting manner into the finger cavities 17 and 17*a*. Thus, the fastening of the male and female elements is relatively easily accomplished by slipping the male end into the female end. Unfastening the belt band is easily accomplished by applying finger pressure against the locking elements 15 and 15*a* to move those elements toward each other and thereby allow removal of the male element 14 from the female fastener 16. Any suitable means 19 may be employed to adjust the length of a belt band.

Another means for fastening the ends of a length of belt band may comprise a conventional buckle with a tongue member on it for insertion into a selected hole or aperture of a series of holes in spaced relationship on the other end of the belt band.

Although the means for securing the belt band about the waist of the forward person may, and in most instances will, comprise fastenable members at opposite ends of the length of the belt band, it is to be emphasized that a continuous or endless belt band may be employed. The means for securing or fastening an endless band about the waist of the forward person may comprise a mechanism for drawing a portion of the length of the endless band into overlapping relationship with other parts of the band and securely maintaining that relationship in use.

Figure 2:
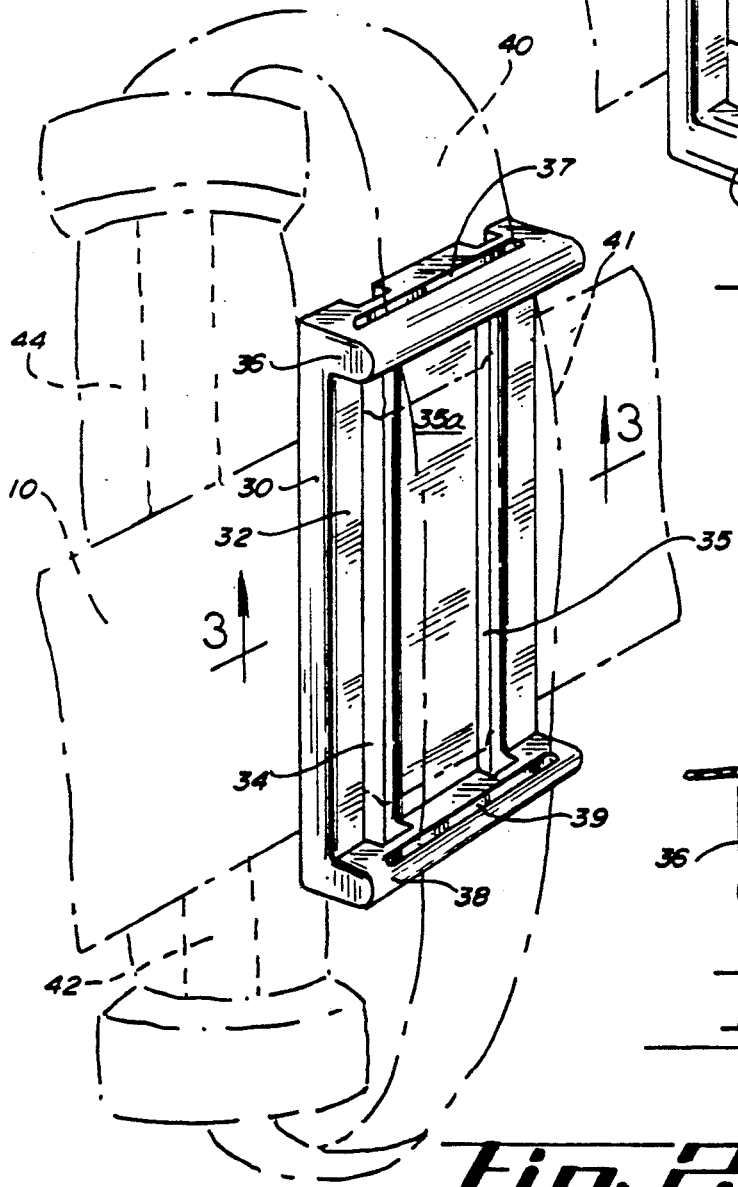
FIG. 2 is a schematic perspective view of one hand grip assembly of the belt of the invention with the anchor member thereof shown in solid lines and the belt band as well as the loop of material and the spool handle shown in phantom.

Referring now to FIG. 2, details for the anchor member 30 as illustrated in FIG. 1 will be explained. Anchor member 30 comprises the base portion 32 in the nature of a relatively flat panel or slightly contoured panel (for the contour of a waist). Base portion 32, which could also be called a brace portion or member, has two slot openings 34, 35 extending transversely through it from its outer surface to its inner or interior face surface 35*a*. These slot openings 34, 35 are vertically oriented as compared to the horizontal orientation of the belt band 10. Preferably slot openings 34, 35 are most preferably spaced from each other so that more than a rod-like narrow stretch of the plate member 32 separates them. Belt band 10 is threaded through one and then through the other of the slot openings 34, 35. As illustrated in FIG. 2, the preferable threading is for the belt band 10 to be threaded from the exterior face or outer face of anchor 30 through opening 34 and then along the inner face 35*a*, and then through slot opening 35 to the exterior face of anchor 30. The threaded relationship of belt band 10 through the anchor 30 at its plate-like brace portion 32 is such that anchor 30 is easily moved along belt band 10 when the belt band is in non-taut condition. In essence, anchor 30 may be slidably adjusted along the length of belt band 10 when the belt band 10 is in non-taut condition. However, when belt band 10 is placed in taut condition about the waist of a forward person of a tandem pair, anchor 30 is not easily slidably moved along the length of belt band 10. In fact, anchor 30 is highly resistant to any movement and is in essence securely held in a selected location on the belt band when the belt band is secured in taut condition about the waist of a forward person.

A further feature of anchor 30, particularly illustrated in FIG. 2, is that of its structure 36 which is a holding structure. It is called a holding structure because it is equipped with a slot opening or aperture 37 which serves as the mounting for holding the loop hand grip material 40, thereby effectively placing the loop 40 in the condition of being carried by the anchor member 30. Ideally, anchor 30 is equipped with a holder member or structure 36 at its upper end as well as a similar holder structure 38 at its lower end, with each having an aperture 37, 39 for passage of the loop of hand grip material through the same. One such holder structure or aperture for anchoring or holding the loop of hand grip material to anchor 30 may alone serve the necessary holding function for carrying the loop 40 with anchor 30; however, by employing an apertured holder at the upper and lower edge of anchor 30, a more reliable orientation of loop 40 in a vertical orientation as compared to the horizontal orientation of belt 10 is achieved. The important functional relationship is that the loop 40 is carried by anchor 30 in a way such that adjustment of the location of anchor 30 at any point along the length of belt 10 will automatically shift loop 40 to that particular point along the length of belt 10. Any suitable means to accomplish this function may be employed; to be recognized is that apertured holders 36 and 38 are preferably at upper and lower extremities of anchor 30. Thus, while FIG. 2 illustrates apertured holders 36, 38 as projecting somewhat interiorly of the inner face 35*a* of the plate-like brace portion 32 of anchor 30, it is within the ambit of this invention to project apertured holders 36, 38 straight up and down from the upper and lower edges of the plate-like brace portion 32, with the apertures 37, 39 for the hand grip loop material 40 oriented for horizontal plane passage of the loop as contrasted to the vertical plane for passage of them illustrated in FIG. 2.

Figure 3:
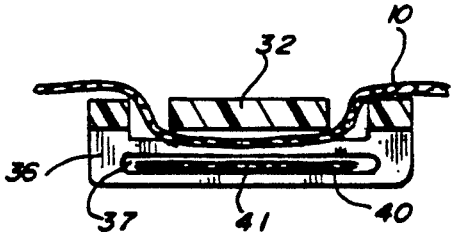
FIG. 3 is a schematic cross-section taken on lines 3—3 of FIG. 2.

The loop 40 is preferably not united in fixed fashion to anchor 30; thus loop 40 may be shifted within holder apertures 37, 39, but is at all times so held by anchor 30 that any movement of anchor 30 along belt band 10 will automatically move loop 40 with it. Further, the loop of hand grip material 40 is carried by anchor 30 in a manner such that the interior stretch 41 of hand grip material 40 (see FIG. 3) is inward of the belt band 10. While this feature is not critical to practice of the invention, it is considered very important from the standpoint of introducing an additional safety feature. By positioning the inner section of the loop of hand grip material 40 interiorly of belt band 10, any possible fracturing or failure of the anchor 30 will not by itself allow the hand grip loop to fall away from belt band 10. Band 10 alone will maintain the loop 40 in condition for hand gripping even if the anchor 30 were to fracture and break away in use. It is of course most preferable to employ relatively sturdy or stiff materials for anchor 30. High impact polystyrene is one such material. Other relatively stiff and tough and strong plastics such as those of methyl methacrylate as well as various polycarbonates may also be useful as the material for forming anchor members of the invention. Metals such as, for example, aluminum may also be used to form the anchor members.

An exterior or outer portion 42 of the hand grip loop 40 extends in spaced relationship exteriorly to the exterior or outer face 13 of the belt band and may itself function as a hand grip member. The loop of material 40 is flexible but tough, and suitably is formed of nylon belting or other materials such as those suitable for use in forming belt band 10. Importantly, the loop of the hand grip material 40 is what some may call an endless loop, meaning that the ends of the material forming loop 40 are firmly fixed together in any suitable manner such as by sewing or by any suitable strong adhesive or by riveting or the like. Preferably, fastened ends of the loop 40 are hidden in an interior channel within a special handle member 44.

Handle member 44 may be molded as a spool in fixed or merged condition on loop 40. It may however be movable along the loop. Ideally it is in the nature of a spool having a central channel within which the ends of the loop 40 are hidden. The spool has sufficient body or size for comfortable hand gripping. Ideally, handle member 44 is formed of foamed elastomeric or rubbery material of any suitable nature, such as, for example, polyurethane. The outer integument or skin of the foamed body of handle 44, including the outer integument forming the interior wall of a channel through handle 44, preferably is fused so as to render it substantially water impervious and thus cause spool handle members 44 to have the characteristic of floating on water. This is beneficial for belt assemblies of the invention as used by water skiers. Although other components of the belt according to the invention may not themselves be floatable or formed of material causing them to float on water, the handle members when of sufficient size as compared to other materials forming the belt of the invention (and preferably light weight materials do form the other components of the belt), can effectively prevent rapid sinking and even contribute to floating of the composite belt of the invention should it be accidentally dropped in the water by a water skier. Advantageously, belts of the invention may be formed of materials having minimum bulk so as to permit folding or "balling up" of the entire composite belt into a carrying case no larger than about the size of a softball (e.g., a ball about 10 cm in diameter).

Figure 4:
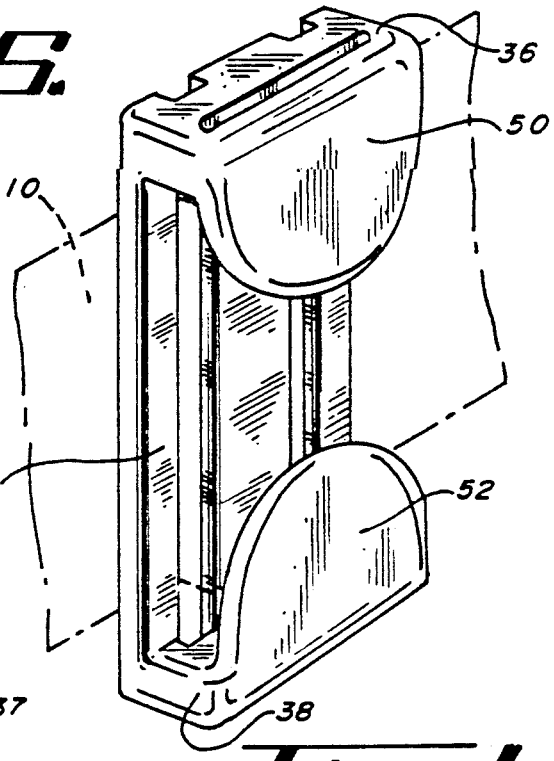
FIG. 4 is an alternate form for an anchor member of the belt of this invention, with a portion of the belt band shown in phantom as it extends in threaded condition through the anchor member.

The modified anchor member, illustrated in FIG. 4, has the additional feature of contoured lip members 50 and 52 extending from the apertured holding structures 36 and 38 to provide a degree of body comfort for the forward person wearing the belt in taut condition.

Figure 5:
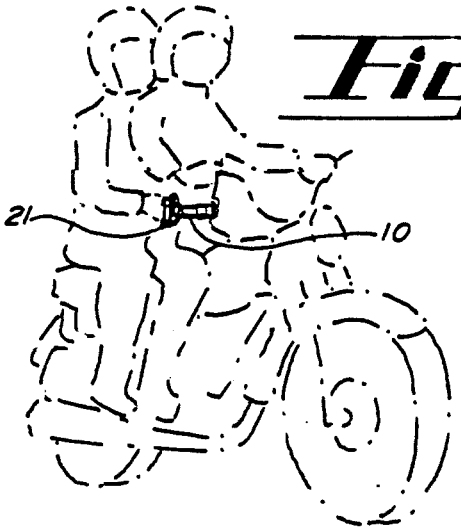
FIG. 5 is a schematic perspective view of the belt of the invention in use by tandem riders on a motorcycle, with the riders and motorcycle shown in phantom.

As illustrated in FIG. 5, the forward person of a tandem pair on a motorcycle is the wearer of the belt 10. It is placed in taut condition about the waist of the forward person. Hand grip assembly 21 is shown in FIG. 5; and an identical hand grip assembly 20 is not visible in FIG. 5. The important point is that the location of hand grip assembly 21, while illustrated in FIG. 5 as being at a lateral side of the forward person, may be adjusted toward the front of the forward person, or adjusted toward a lateral rear portion behind the forward person. Adjustment to various locations for the comfort of the rearward person is a vital consideration to save the rearward person from suffering excessive fatigue in the arms and hands. Thus, the hand grip assemblies may be adjusted toward the front of the waist of the forward person to permit resting of the arms of the rearward person at the sides of the waist of the forward person for a period of time. When that position of hand gripping causes unnecessary tenseness or fatigue in the arms or hands of the rearward person, only a slight pause to loosen the belt band 10 and allow adjustment of the location of the hand grips is necessary. Different locations for the hand grips change the muscle tension or mental attitude for muscle tension by the rearward person, thereby reducing the tendency toward fatigue and enhancing safety.

A further feature of the invention that helps to reduce fatigue is the varied position or angular slant at which the rearward person may orient his or her hands during tandem use of the belt. The flexibility of the loop 40 of hand grip material permits hand orientation by the rearward person in a vertical plane or in any angle almost to the point of a horizontal plane with respect to the belt band. Changes of hand orientation from the vertical to almost the horizontal may be made at any time by the rearward person during tandem use. The lack of any required rigid hand grip orientation by the rearward person adds to comfort and attentiveness of the rearward person, thereby further contributing to safety in use.

Those skilled in the art will readily recognize that this invention may be embodied in still other specific forms than illustrated without departing from the spirit or essential characteristics of it. The illustrated embodiment is therefore to be considered in all respects illustrative and not restrictive, the scope of the invention being indicated by the appended claims rather than the foregoing description; and all variations that come within the meaning and range of equivalency of the claims are therefore intended to be embraced thereby.

What is claimed is:

1. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for slidable adjustability to different locations along said belt band, and b) a loop of tough and pliable material carried by said anchor member with a portion of the loop in spaced relationship from said belt band for hand gripping by said rearward person.

2. The belt of claim 1 wherein said mounting of each said anchor member comprises a threaded mounting such that each said anchor member is securely held at a selected location on said belt band when said belt band is secured in taut condition about the waist of the forward person.

3. The belt of claim 1 wherein each said anchor member comprises a relatively rigid brace part having slot openings oriented transversely to said belt band for threaded mounting of said anchor members on said belt band.

4. The belt of claim 3 wherein said brace part of said anchor member comprises a plate-like structure.

5. The belt of claim 1 wherein each said anchor member includes an aperture within which a portion of said loop of material is lodged for carrying by said anchor member.

6. The belt of claim 1 wherein each said anchor member includes upper and lower edges, an aperture at each said upper and lower edge and wherein the loop of material carried by the anchor member is lodged in each said aperture of the anchor member.

7. The belt of claim 1 wherein said belt band has an interior face oriented toward the waist of the forward person and wherein each said loop of material includes an interior portion extending interiorly of said belt band.

8. The belt of claim 1 wherein each said anchor member includes a contoured lip portion facing the waist of the forward person, said lip portion contour being such as to provide waist comfort for the forward person of a tandem pair.

9. The belt of claim 1 wherein each said hand grip assembly additionally comprises a handle member in the nature of a spool mounted on the loop of material of said assembly, with a portion of the loop extending through the interior of said handle member.

10. The belt of claim 9 wherein said handle member comprises foamed elastomeric material.

11. The belt of claim 1 wherein said loop of material carried by said anchor member has an interior portion extending interiorly of said belt band.

12. The belt of claim 1 wherein s id belt band has an interior face oriented toward the waist of the forward person and said anchor member has an interior face also oriented toward the waist of the forward person, and wherein each said loop of material includes an interior portion extending interiorly of not only the interior face of said anchor member but also the interior face of said belt band.

13. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, said mounting of said anchor member comprising a threaded mounting such that said anchor member is securely held at a selected location on said belt band when said belt band is secured in taut condition about the waist of the forward person, and b) a loop of tough and pliable material carried by said anchor member with a portion of the loop in spaced relationship from said belt band for hand gripping by said rearward person, said belt band being encircled by said loop.

14. The belt of claim 13 wherein each said anchor member includes an aperture within which a portion of said loop of material is lodged for carrying by said anchor member.

15. The belt of claim 13 wherein each said anchor member includes upper and lower edges, an aperture at each said upper and lower edge and wherein the loop of material carried by the anchor member is lodged in each said aperture of the anchor member.

16. The belt of claim 13 wherein each said hand grip assembly additionally comprises a handle member in the nature of a spool mounted on the loop of material of said assembly, with a portion of the loop extending through the interior of said handle member.

17. The belt of claim 16 wherein said handle member comprises foamed elastomeric material.

18. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, and b) a loop of tough material carried by said anchor member with a portion of the loop in spaced relationship from said belt band for hand gripping by said rearward person, wherein said mounting of each said anchor member comprises a threaded mounting such that each said anchor member is securely held at a selected location on said belt band when said belt band is secured in taut condition about the waist of the forward person.

19. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an another member mounted on said belt band for adjustability to different locations along said belt band, and b) a loop of tough material carried by said anchor member with a portion of the loop in spaced relationship from said belt band for hand gripping by said rearward person, wherein each said anchor member comprises a relatively rigid brace part having slot openings oriented transversely to said belt band for threaded mounting of said anchor member on said belt band.

20. The belt of claim 19 wherein said brace part of said anchor member comprises a plate-like structure.

21. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, and b) a loop of tough material carried by said anchor member with a portion of the loop in spaced relationship from said belt band for hand gripping by said rearward person, wherein each said anchor member includes an aperture within which a portion of said loop of material is lodged for carrying by said anchor member.

22. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, and b) a loop of tough material carried by said anchor member with a portion of the loop in spaced relationship from said belt band for hand gripping by said rearward person, wherein each said anchor member includes upper and lower edges, an aperture at each said upper and lower edge and wherein the loop of material carried by the anchor member is lodged in each said aperture of the anchor member.

23. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, and b) a loop of tough material carried by said anchor member with a portion of the loop in spaced relationship from said belt band for hand gripping by said rearward person, wherein each said anchor member includes a contoured lip portion facing the waist of the forward person, said lip portion contour being such as to provide waist comfort for the forward person of a tandem pair.

24. A stabilizing belt for a tandem pair of persons, comprising a pliable belt band, means for securing the band about the waist of the forward person of a tandem pair, and at least two discrete hand grip assemblies for the rearward person of a tandem pair, each said hand grip assembly comprising:

a) an anchor member mounted on said belt band for adjustability to different locations along said belt band, and b) a loop of tough material carried by said anchor member with a portion of the loop in spaced relationship from said belt band for hand gripping by said rearward person, wherein each said hand grip assembly additionally comprises a handle member in the nature of a spool mounted on the loop of material of said assembly, with a portion of the loop extending through the interior of said handle member, and wherein said handle member comprises foamed elastomeric material.

* * * * *